US008414035B2

(12) United States Patent
Bell

(10) Patent No.: US 8,414,035 B2
(45) Date of Patent: Apr. 9, 2013

(54) SYSTEM AND METHOD FOR PROVIDING KNOT TYING

(75) Inventor: Matthew Bell, Sunol, CA (US)

(73) Assignee: Dartmouth College, Hanover, NH (US)

( * ) Notice: Subject to any disclaimer, the term of this patent is extended or adjusted under 35 U.S.C. 154(b) by 170 days.

(21) Appl. No.: 12/984,952

(22) Filed: Jan. 5, 2011

(65) Prior Publication Data

US 2011/0187100 A1 Aug. 4, 2011

Related U.S. Application Data

(60) Provisional application No. 61/292,484, filed on Jan. 5, 2010.

(51) Int. Cl.
*B65H 69/04* (2006.01)

(52) U.S. Cl. ..... 289/13; 289/15

(58) Field of Classification Search ..... 289/2, 13, 289/15, 18.1

See application file for complete search history.

(56) References Cited

U.S. PATENT DOCUMENTS

| | | | | | |
|---|---|---|---|---|---|
| 876,573 | A * | 1/1908 | Myers | 53/138.7 |
| 2,705,656 | A * | 4/1955 | Shockey | 289/17 |
| 2,913,270 | A * | 11/1959 | Sachsenroder, Sr. et al. | 289/2 |
| 2,913,271 | A * | 11/1959 | Sachsenroder, Sr. et al. | 289/2 |
| 3,336,063 | A * | 8/1967 | Remmers | 289/2 |
| 3,490,801 | A * | 1/1970 | Feighery | 289/2 |
| 3,563,583 | A * | 2/1971 | Gentry et al. | 289/2 |
| 3,591,217 | A * | 7/1971 | Melzer | 289/2 |
| 4,572,555 | A * | 2/1986 | Henderson, Jr. | 289/17 |
| 7,883,122 | B2 * | 2/2011 | Orko et al. | 289/17 |
| 7,959,193 | B2 * | 6/2011 | Ng | 289/15 |
| 2008/0315023 | A1 * | 12/2008 | Orko et al. | 242/157 R |

OTHER PUBLICATIONS

Bell, Matthew; Balkcom, Devin Knot Tying with Single Piece Fixtures; IEEE International Conference on Robotics and Automation (ICRA), May 2008.

Bell, Matthew; Flexible Object Manipulation, A Thesis Submitted to the Faculty of Dartmouth College, Hanover NH, Feb. 2010.

* cited by examiner

*Primary Examiner* — Shuan R Hurley

(74) *Attorney, Agent, or Firm* — Peter A. Nieves; Sheehan Phinney Bass + Green PA

(57) ABSTRACT

A knot tying system is presented containing a feeding mechanism, a knot tying device, and a clamp. The feeding mechanism has a drive roller and an idle roller capable of guiding a wire. A truck is connected to the end of the wire, and fed into a guide track, fixed relative to the feeding mechanism. The guide track provides a curved track in the shape of a knot desired. The track has a tube having a wire extraction slot running along the length of the tube, an intersection region where an outer portion of the guide track intersects an inner portion of the guide track, and a slit through the inner portion of the guide track substantially at the intersection region. A sensing and control system may also be present.

24 Claims, 18 Drawing Sheets

SYSTEM AND METHOD FOR PROVIDING KNOT TYING

CROSS-REFERENCE TO RELATED APPLICATIONS

This application claims the benefit of U.S. Provisional Patent Application Ser. No. 61/292,484 filed Jan. 5, 2010, entitled "SYSTEM AND METHOD FOR PROVIDING KNOT TYING." This provisional application is incorporated herein as if fully set forth.

GOVERNMENT SUPPORT

This invention was made with government support under Contract Number IIS-0643476 awarded by NSF and Contract Number CNS-0708209 awarded by NSF. The government has certain rights in the invention.

FIELD OF THE INVENTION

The present invention relates to wire handling, and more particularly, is related to forming knots in wire.

BACKGROUND

Knot tying generally requires inserting one end of a wire or string through loops formed in the wire. Handling of the wire during the knotting process is therefore relatively complex, as the end is guided to the loop, released as it is inserted through the loop, and then re-grasped after the end has passed through the loop.

Previous automated knot tying apparatus have generally employed robotic means where the material being knotted is held and released at different points during the knotting process. Such apparatus are generally expensive. Further, such apparatus are best suited for less rigid knot tying material. Tying a bundle of wires into a knot may be particularly challenging, as the bending forces may result in the individual strands within the bundle splaying out in different directions, making it difficult to release and then re-grasp all the strands of the bundle as the bundle is being knotted.

Therefore, there is an unmet need for a low cost apparatus for knotting a single wire or a bundle of wires where the wire or bundle is not released and re-grasped during the knotting process.

SUMMARY

Accordingly, the present invention is directed to a system for tying knots. The system includes a feeding mechanism with a drive roller and an idle roller capable of guiding a wire, a truck, removably connected to an end of the wire, and a guide track. The guide track is fixed relative to the feeding mechanism and configured to slideably contain the truck. The guide track provides a curved track in the shape of a knot desired, and includes a wire ingress end and a wire egress end. The track has a tube having a wire extraction slot running along the length of the tube. At intersection regions where an outer portion of the guide track intersects an inner portion of the guide track, there is a slit through the inner portion of the guide track substantially at the intersection region.

The truck may include a cap and a magnet located inside the cap, wherein the wire is loosely gripped by the magnet. In addition, the system may include a wire clamping mechanism located substantially at the guide track wire egress end. The system may include a means for returning the truck from the guide track wire egress end to the guide track wire ingress end.

Another aspect of the invention is an apparatus for tying knots in a wire. The apparatus includes a slotted guide track with an ingress end and an egress end. The guide track provides a curved path for the wire passing therethrough in the shape of a knot desired. A clamp at the guide track egress end is used to secure the wire near the guide track egress end. The guide track has an extraction slit passing entirely through the guide track, whereby the wire may be extracted from the guide track while the wire is attached near the ingress end and attached in the clamp. The apparatus may include a wire feeder capable of guiding a wire to the guide track ingress end. The wire feeder may have a wire feed path and a wire feeder extraction path whereby the wire may be removed from the wire feed path independently of the wire feed path. The wire feeder may have a drive roller and an idle roller capable of guiding a wire, and a pinch gap having a pinch gap size consisting of a distance between the drive roller and the idle roller. The pinch gap size may be adjustable. The wire feeder extraction path may have a slot in the wire feeder running substantially parallel to the wire feed path.

The apparatus may include a means for drawing the wire through the guide track. The means for drawing the wire through the guide track may include a truck slideably disposed substantially within the guide track, the truck having a wire end securing means. The truck wire end securing means may include a magnet or a clamp. The means for drawing the wire through the guide track may include feeding the wire into the guide track with the wire feeder, thereby advancing the truck through the guide track. The means for drawing the wire through the guide track may include blowing air through guide thereby advancing the truck through the guide track.

The knot tying apparatus may further include a clamp sensor, a wire feeding mechanism feed path ingress sensor, and a guide track egress sensor. The apparatus may further include a controller in communication with the clamp sensor, the wire feeding mechanism feed path ingress sensor, and the guide track egress sensor.

Another aspect of the invention is a method for tying a knot in a wire. This method includes the step of forming a slotted guide track substantially in the shape of a desired knot, where the guide track has an ingress end and an egress end. Another step is forming an extraction slit substantially through the slotted guide track at a location in the guide track between the ingress end and the egress end. Further steps include guiding the wire into the guide track ingress end, passing the wire substantially through the guide track to the egress end, clamping the wire substantially at the egress end of the guide track with a clamp, and extracting the wire from the guide track while the wire is clamped substantially by pulling the wire through the guide track slot and pulling the wire through the extraction slit.

The method may also include the steps of inserting a wire into a wire feeder, the wire feeder having a feed path with a feed path ingress and a feed path egress, and a wire extraction path, the wire extraction path including a slot through the wire feeder substantially parallel to the feed path; and engaging the wire in a wire feeder wire advancement mechanism. Additional steps may include detecting a wire at the feed path ingress, activating the wire feeder advancement mechanism, detecting the wire at the guide track egress end, stopping the wire feeder advancement mechanism, activating an automated clamp closing mechanism, detecting when the wire is secured in the clamp, reversing the wire feeder wire advancement mechanism, detecting when a knot in the wire has formed, and disengaging the wire from the wire feeder advancement mechanism.

Another aspect of the invention is a knot tying system having a computer readable media configured to perform the steps of sensing a wire at the feed path ingress, starting the wire feeder advancement mechanism, sensing the wire at the guide track egress end, stopping the wire feeder advancement mechanism, activating an automated clamp closing mechanism, sensing when the wire is secured in the clamp, reversing the wire feeder wire advancement mechanism, and disengaging the wire from the wire feeder advancement mechanism. The computer readable media may be configured to perform the step of sensing when a knot in the wire has been formed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

DEFINITIONS

Figure 1:
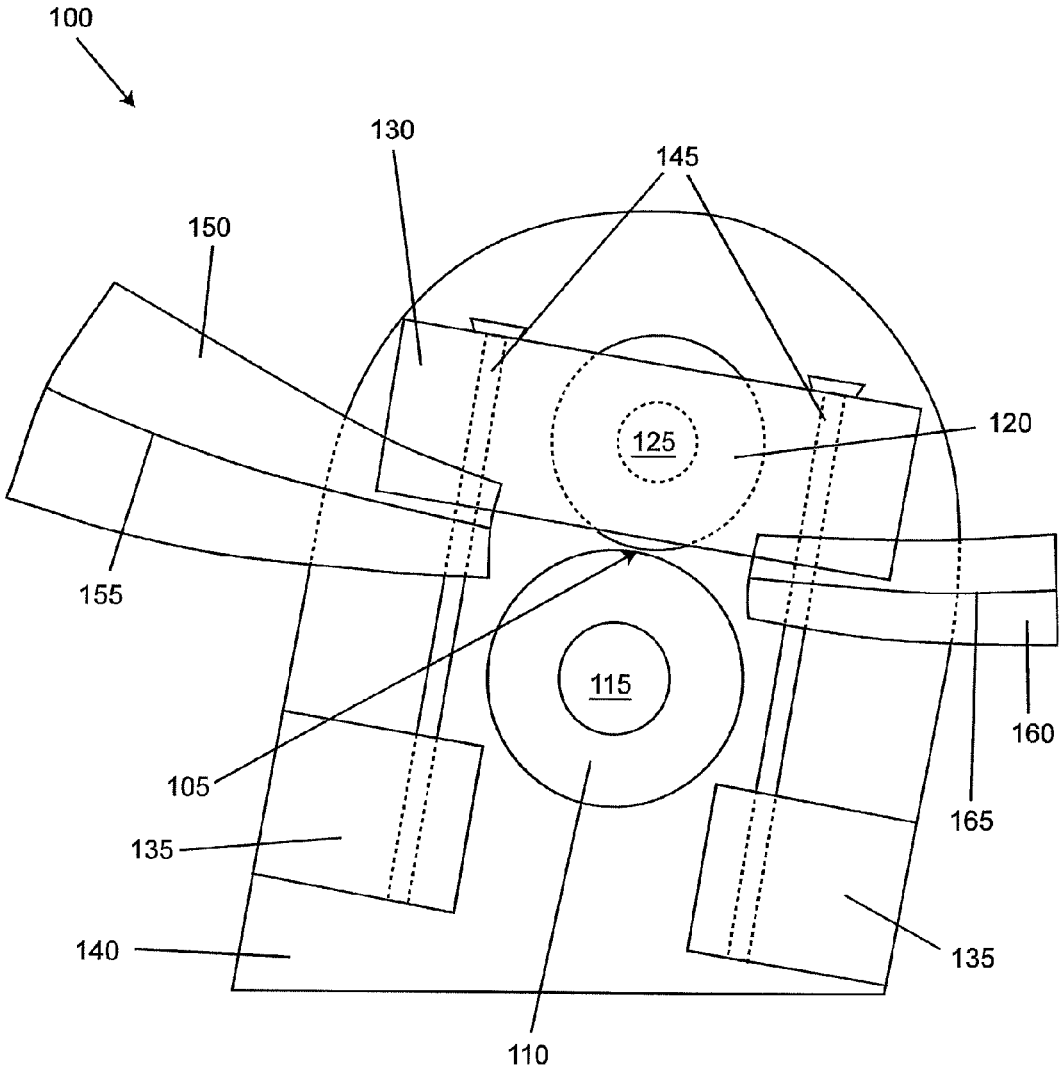
FIG. 1 is a side view diagram of a wire feeder of the first embodiment of the knot tying apparatus.

The following definitions are useful for interpreting terms applied to features of the embodiments disclosed herein, and are meant only to define elements within the disclosure. No limitations on terms used within the claims are intended, or should be derived, thereby. Terms used within the appended claims should only be limited by their customary meaning within the applicable arts.

As used within this disclosure, "wire" is used for the material being knotted. A wire may refer to a relatively rigid material, such as a metal wire or plastic fiber, and a wire may refer to a relatively non-rigid material, such as a string or rubber band. The term "wire" may refer to a single strand or a bundle of strands. As used within this disclosure, "string" refers to a relatively non-rigid knotting material.

DETAILED DESCRIPTION

Reference will now be made in detail to embodiments of the present invention, examples of which are illustrated in the accompanying drawings. Wherever possible, the same reference numbers are used in the drawings and the description to refer to the same or like parts.

The present knot tying apparatus and system is presented containing a feeding mechanism, a knot tying device, and a clamp. A sensing and control system may also be present. The control system may be provided, for example, by a programmable microcontroller.

Feeding Mechanism

FIG. 1 shows a wire feeding mechanism 100 of a first embodiment of the knot tying apparatus. The wire feeding mechanism 100 contains a drive roller 110 and an idle roller 120. The drive roller rotates around a drive roller axle 115, and the idle roller rotates around an idle roller axle 125. The drive roller 110 is rotated by a drive means, for example a crank or a motor (not shown). Under the first embodiment, the drive means is a standard 24V DC gear motor, which runs at low RPM in both forward and reverse. The motor may be controlled with an electronic speed control (ESC) that accepts pulse-width modulated (PWM) input, provided by a control system described below. Of course, in other embodiments different drive means may be used within the scope of this disclosure, for example, direct drive motors or belt driven motors.

In contrast, the idle roller 120 is not rotated by a drive means, but may rotate when, for example, the idle roller 120 is in contact with the drive roller 110. A frame 130 for the idle roller 120 is attached to a motor mounting plate 140 by two long screws 145 that terminate in back plate attachment blocks 135. The long screws 145 may be used to adjust the distance between the idle roller 120 and the drive roller 110 (also known as the "pinch gap" 105), and the screws 145 may similarly be used to adjust the compression between the rollers, allowing for easy adjustment for different kinds of wire. The rollers 110, 120 may be, for example, but not limited to, standard pinch rollers.

Figure 3:
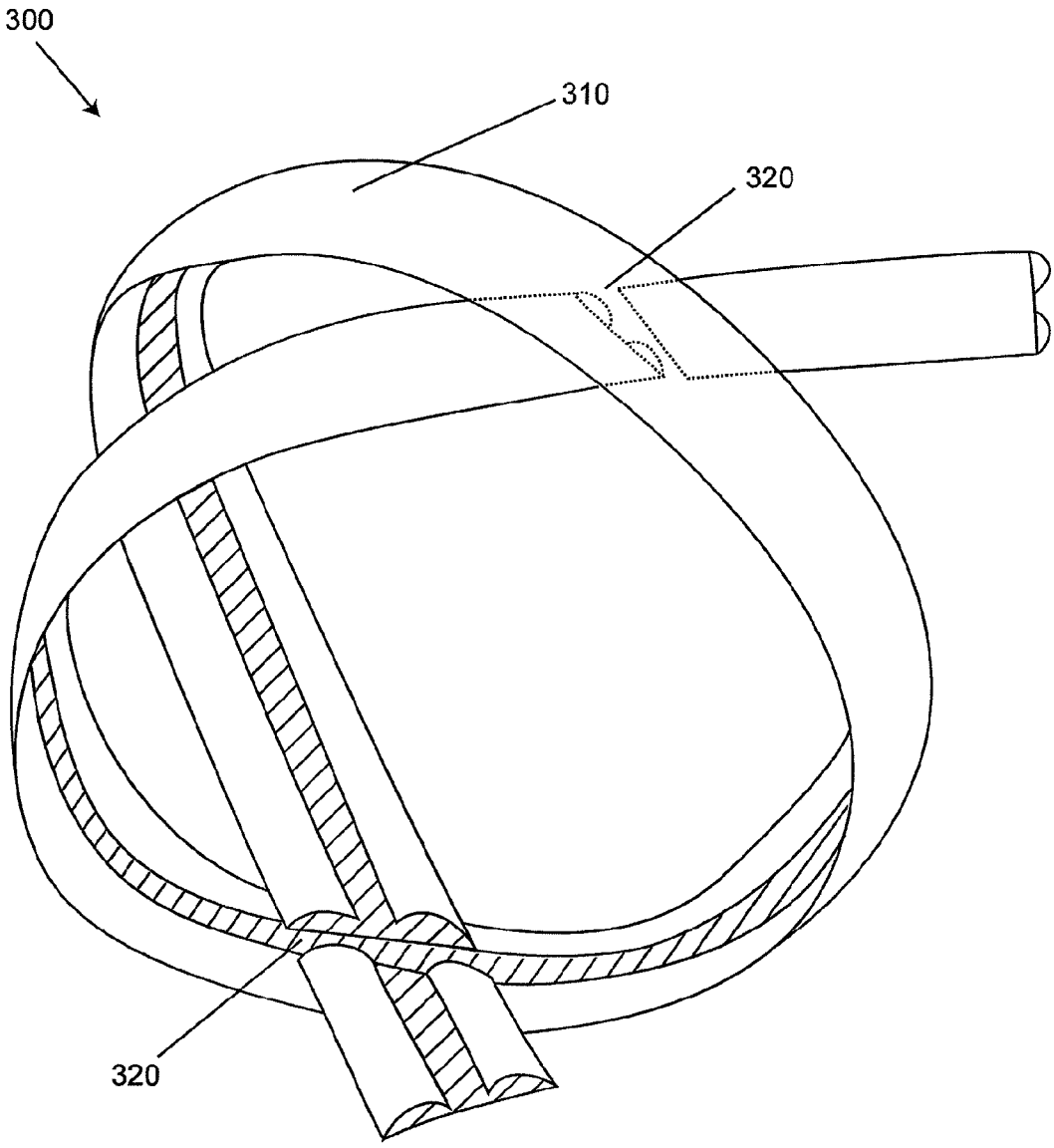
FIG. 3 is a diagram showing the knot tying portion of the first embodiment of the knot tying apparatus.

The feeding mechanism 100 has an ingress guide tube 150 and an egress guide tube 160. A wire (not shown) is inserted, for example, manually, into the ingress guide tube 150, which guides the wire between the rollers 110, 120, and into the egress guide tube 160. The egress guide tube 160 may be positioned to further guide the wire into a knot tying portion 300 (FIG. 3, see below). The guide tubes 150, 160 may each have an extraction slot 155, 165. In the first embodiment, the extraction slots 155, 165 are formed by splitting the guide tubes 150 and 160 in half, where the upper portion of each guide tube is attached to the idle roller frame 130, and the lower portion is adjustable in the vertical direction, allowing adjustment for different wire thicknesses.

Figure 2:
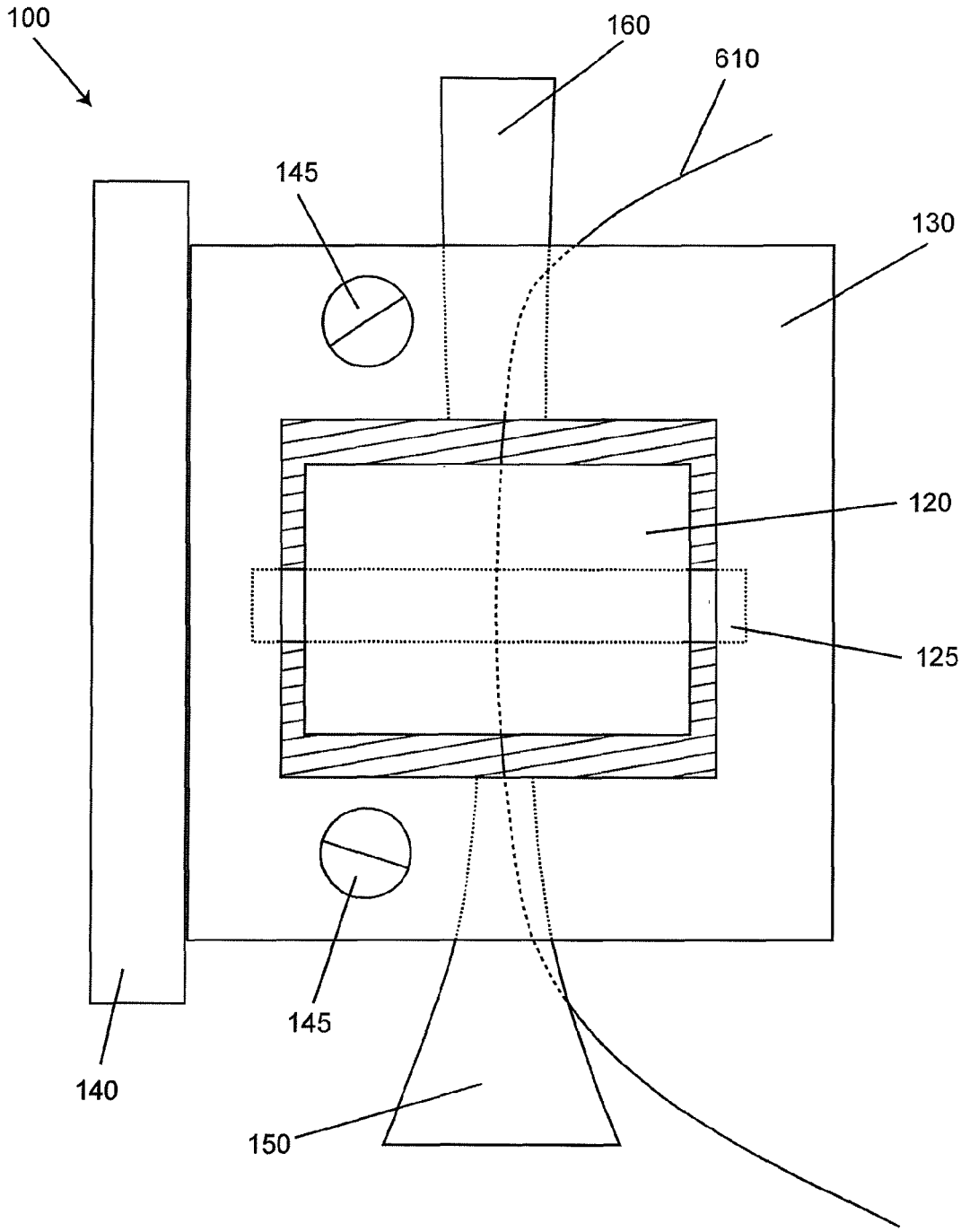
FIG. 2 is a top view diagram of a wire feeder of the first embodiment of the knot tying apparatus.

The guide tube extraction slots 155, 165 and adjustable idle roller frame 130 allow for extraction of the wire from the wire feeding mechanism 100, after a knot has been tied in the wire, since a knotted wire may not be able to pass back through the tubes 150, 160 and rollers 110, 120. The extraction path of a wire 610 may be more easily seen in the top view of the wire feeding mechanism 100 of FIG. 2. Note that the drive roller axle 115 and the roller 110 have been omitted from FIG. 2 to more clearly show the extraction path for the wire 610. Loosening the long screws 145 raises the idle roller frame 130 and opens the pinch gap 105 (FIG. 1), which may further facilitate sliding the wire out through the guide tube extraction slots 155, 165 (FIG. 1). As described below, the screws 145 may be motorized or otherwise automated. Note that there is no objection to using other means to adjust the pinch gap 105 (FIG. 1) between the rollers 110, 120, such as gears or hydraulics.

Knot Tying Portion

A knot tying portion 300 of the first embodiment of the knot tying apparatus is shown in FIG. 3. The knot tying portion 300 is formed to accommodate a sliding piece 400 or truck shown in FIG. 4 that moves along a curved track 310. The curved track 310 is formed in the shape of a knot. Note that in general when a wire is pushed along a curve, such as the curved track 310, the wire tends to position itself towards the outside, where the tube constraints it to move in the desired direction. In contrast, when the wire is pulled, it moves towards the inside of the curved track 310, which is unconstrained in the knot tying portion 300.

Figure 4A:
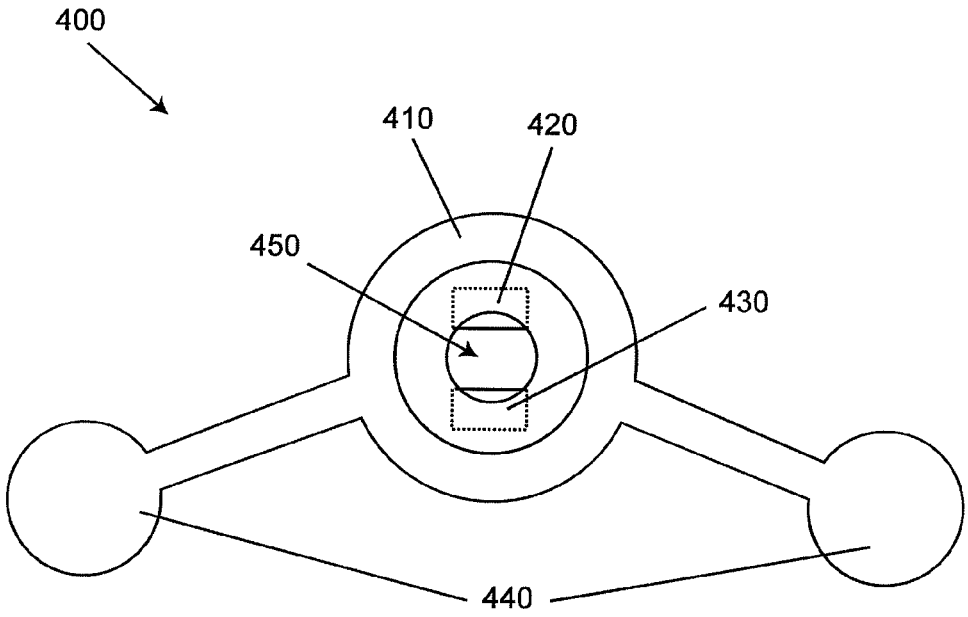
FIG. 4A and FIG. 4B are diagrams of the truck portion of the knot tying apparatus under the first embodiment of the knot tying apparatus.
Figure 4B:
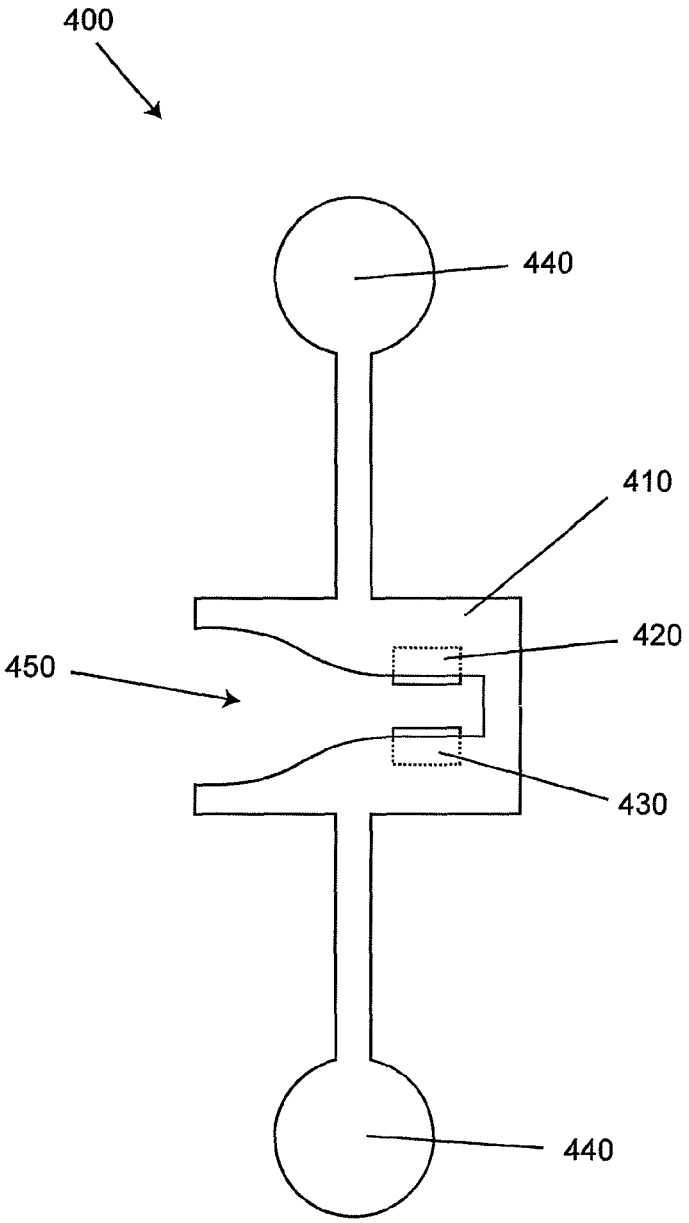

FIG. 4A and FIG. 4B show two views of the truck 400 under the first embodiment of the knot tying apparatus. FIG. 4A shows the truck 400 from an end view, looking into a wire insertion cavity 450 of a truck cap 410. One purpose of the truck 400 is to cap sharp ends of the wire as it is fed through the curved track 310 (FIG. 3). Without this cap, the wire may dig into the sides of the track 310 (FIG. 3), particularly in embodiments where the track 310 (FIG. 3) is made from a soft material, such as plastic, and where damage to the track 310 (FIG. 3) might otherwise make it difficult to push the wire. Another purpose of the truck 400 is to retain the wire within the track 310 (FIG. 3), particularly at points where the track 310 (FIG. 3) may have slits cut through it where the wire might otherwise become snagged. In the first embodiment of the knot tying apparatus, guide bearings 440 are used to retain the truck 400 within the track 310 (FIG. 3) as described below.

Note that under the first embodiment of the knot tying apparatus, the track 310 is configured so that the truck 400 generally remains contained within the track 310. However, there is no particular objection to alternative embodiments where the truck 400 may be removed from the track 310 and thereafter the truck 400 may be re-inserted into the track 310. For example, the wire 610 may be inserted into the truck 400 before the truck 400 is contained within the track 310, and the truck 400 containing the wire 610 may be thereafter inserted into the track 310.

FIG. 4B is a diagram of the truck 400 showing a cutaway view of the cap 410. Under the first embodiment, a top magnet 420 and a bottom magnet 430 are located within the wire insertion cavity 450 of the truck cap 410 to function as a passive gripping system for ferrous wires. While the magnets 420, 430 in the first embodiment have a vertical (top and bottom) orientation, there is no objection to the magnets 420, 430 having other orientations, for example, side to side. The wire is loosely gripped by the magnets 420, 430, preventing the wire from slipping free of the truck 400.

Figure 4C:
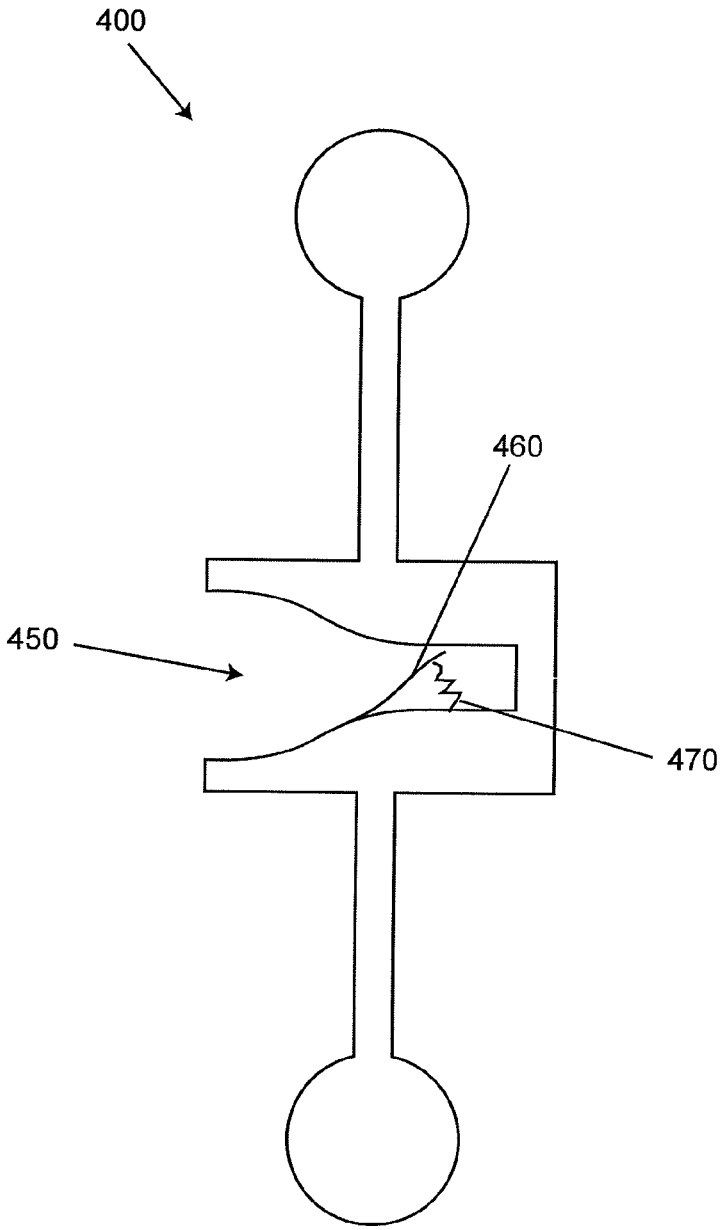
FIG. 4C is a diagram of an alternative embodiment of the truck portion of the knot tying apparatus with a wire clamp.

FIG. 4C shows a diagram of an alternative embodiment of the truck 400 showing a cutaway view of the cap 410 (FIG. 4B). In the alternative embodiment, the knot tying system may be used for non-ferrous materials (which may be, but are not limited to, aluminum wire or fishing line). The magnets 420, 430 (FIG. 4B) are replaced by a passive clamp 460. Of course, there is no particular objection to using a clamp 460 for ferrous materials as well as non-ferrous materials. The passive clamp 460 may be held closed, for example, by a weak spring 470. Other clamping means for retaining the wire within the truck 400, for example, a screw clamp, are familiar to persons having ordinary skill in the art, and are likewise within the scope of this disclosure.

Figure 5A:
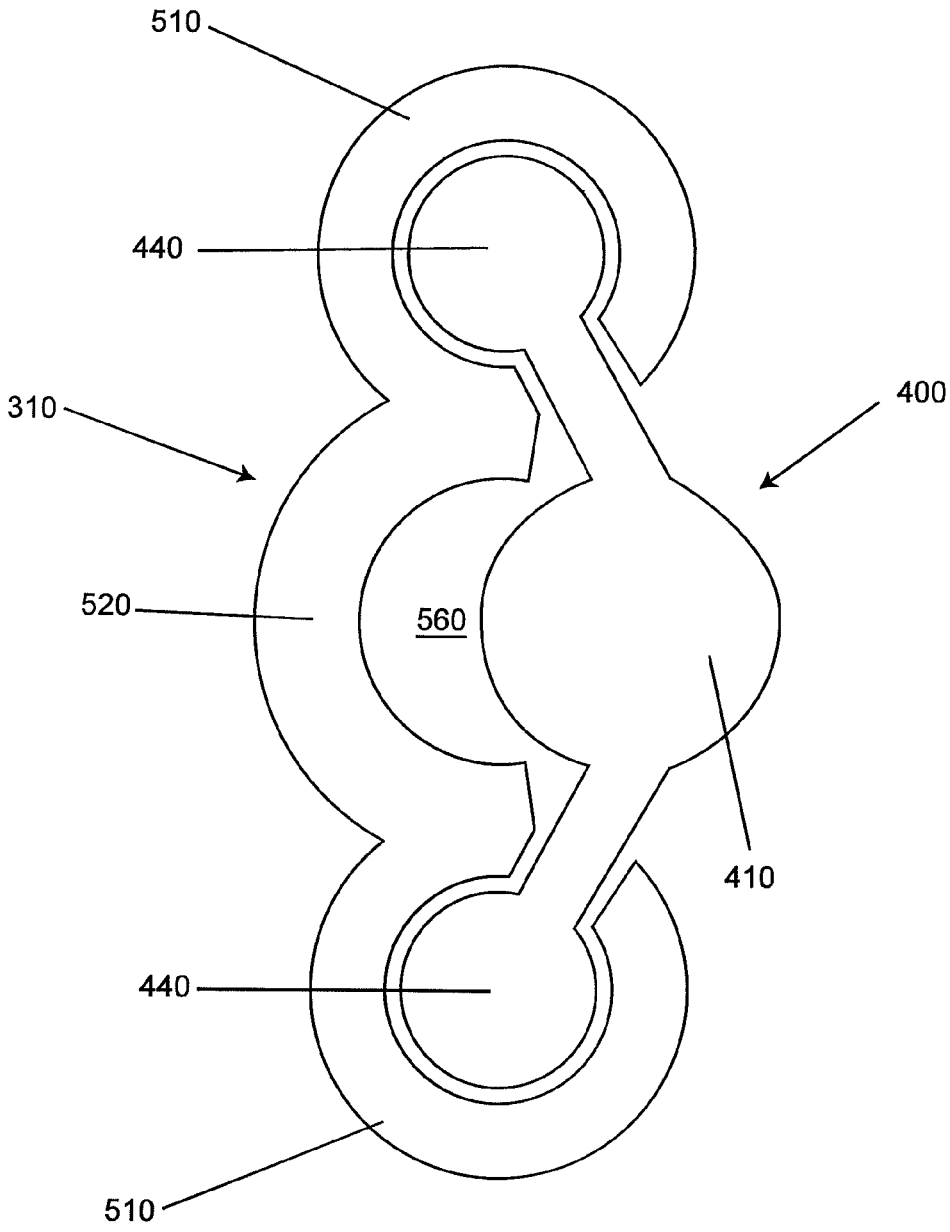
FIG. 5A shows a cross section of the first embodiment of the knot tying apparatus truck and track.

FIG. 5A shows a cross section of the track 310 under the first embodiment. In cross-section, the track 310 is made of a pair of mostly enclosed tubes 510 on the top and bottom of a mostly open curved tube 520. The mostly enclosed tubes 510 guide the guide bearings 440 of the truck 400, while the mostly open curved tube 520 guides the cap 410 holding the wire (not shown). An open area 560, or wire extraction slot, of the mostly open curved tube 520 provides a path for extracting the wire after the knot has been tied.

Figure 5B:
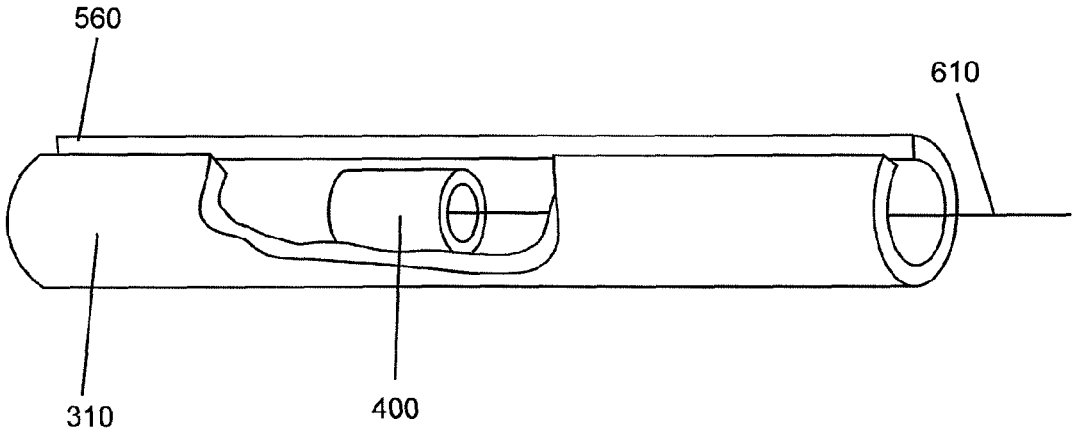
FIG. 5B shows a cross section of a second embodiment of the knot tying apparatus truck and track.

In a second embodiment, as shown in FIG. 5B, the track 310 may not make use of two mostly enclosed tubes 510 around a mostly open curved tube 520, but may instead use a single, slotted tube 310, where the truck 400 is a capsule that is substantially cylindrical in shape with a diameter smaller than the inner diameter of the track 310, but substantially larger than the width of the wire extraction slot 560, thereby retaining the truck within the track 310. Similarly, other cross section geometries of the track 310 and the corresponding truck 400 are possible, providing they allow the truck 400 to guide a wire 610 through the track 310 and provide a wire extraction slot 560. For example, the track 310 may have a substantially rectangular cross section.

Returning to FIG. 3, the track 310 in the first embodiment is formed in the shape of an overhand knot. Two slit regions 320 through interior portions of the track 310 at intersections with exterior portions of the track 310 allow the wire to pass through interior portions of the track 310, enabling the tightening of the knot. In other embodiments, the track 310 may be formed in the shape of other knots, for example, a bowline knot. In such other embodiments, the track 310 may have more slit regions 320, for example, three slit regions 320, or fewer slit regions, for example, one slit region 320. Similarly, other alternative embodiments may use multiple tracks to form knots from multiple wires. For example, a square knot may use two tracks, each track having a feeder and clamp.

Figure 6:
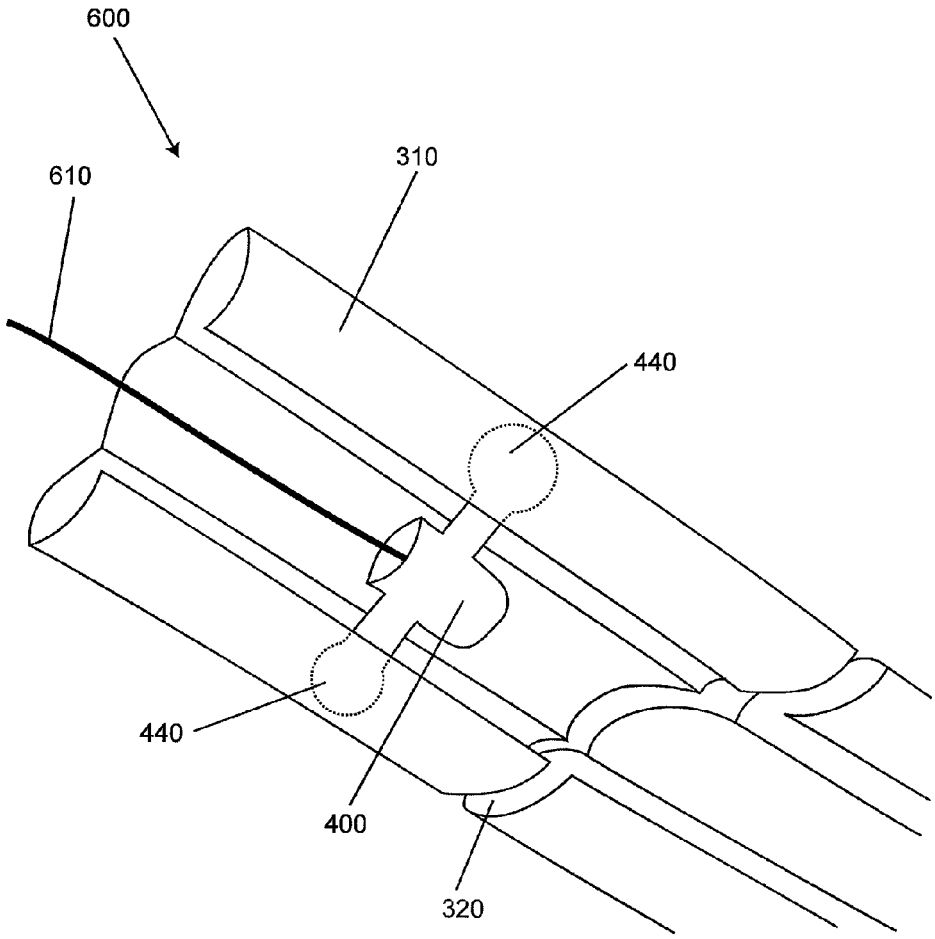
FIG. 6 shows the ingress end region of the knot tying mechanism track of the first embodiment.

FIG. 6 shows an ingress end of the knot tying mechanism track 310 of the first embodiment. As shown in FIG. 6, a wire 610 is inserted into the truck 400 at the ingress end of the track 310. The wire 610 may be secured within the truck by, for example, magnets or clamps, as described above. The wire 610 is then fed into the track 310, for example, by the wire feeding mechanism 100 (FIG. 1), and the force of the wire being fed by the wire feeding mechanism 100 (FIG. 1) advances the truck 400 through the track 310. Note that the relatively large diameter of the guide bearings 440 in relation to the small width of the slit region 320 may allow the guide bearings 440 and the truck 400 to traverse the slit region 320 without becoming snagged.

Figure 7:
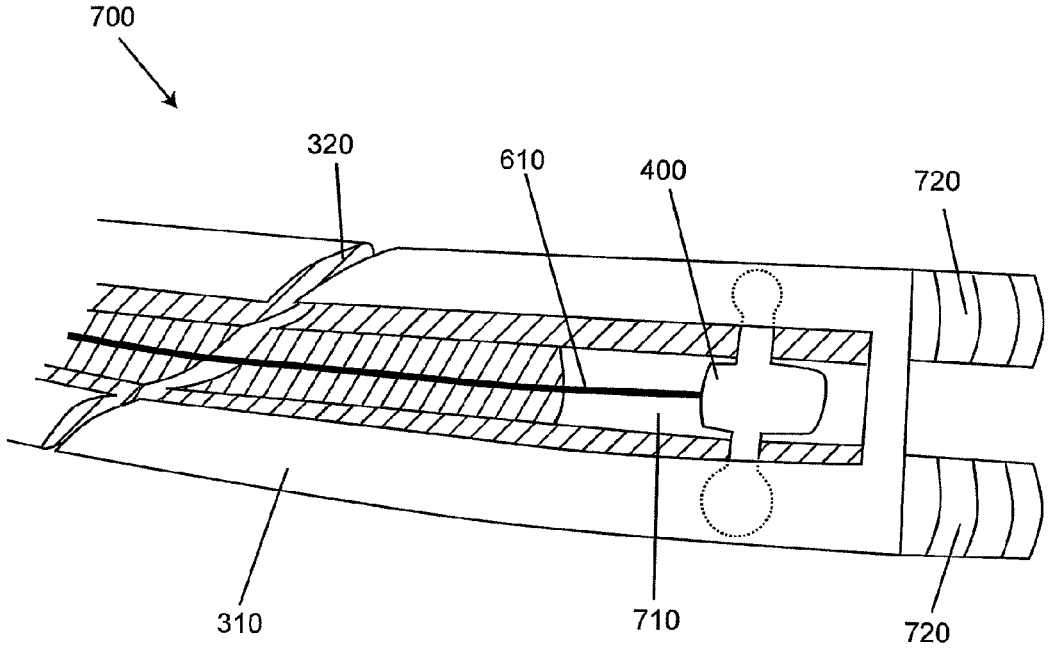
FIG. 7 shows the track egress region of the first embodiment.
Figure 8:
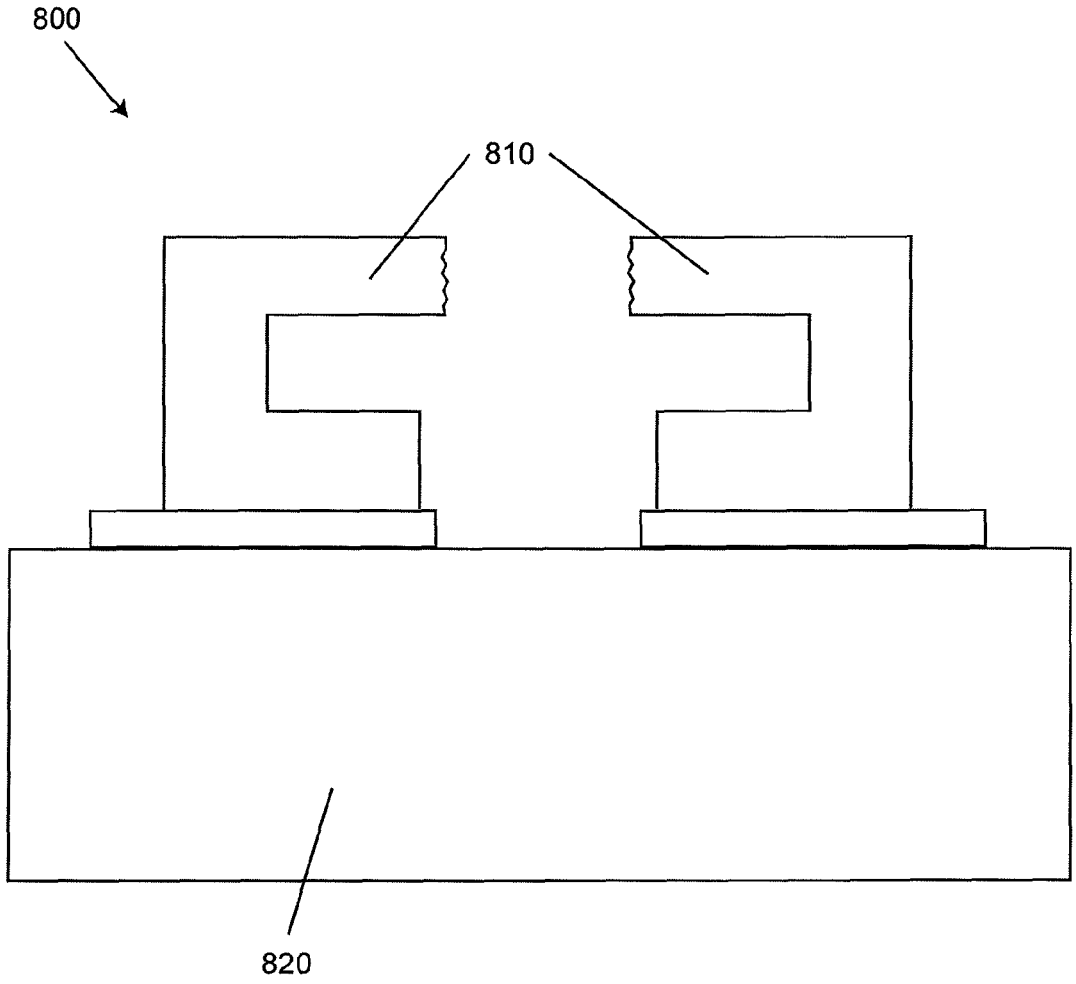
FIG. 8 shows a first view of the clamping mechanism of the first embodiment, with the clamp open.

FIG. 7 shows an egress end 700 of the knot tying mechanism track 310. Once the wire 610 has been pushed through the length of the track 310, it arrives at an egress region at the end of the track where the wire 610 may be secured, for example, by a clamping mechanism 800 (FIG. 8). FIG. 7 shows the track egress region 700 under the first embodiment where a portion of the track 310 has been cut away at an egress end aperture 710, providing access for the clamping mechanism 800 (FIG. 8) to grasp the wire 610.

Clamping Mechanism

Figure 9:
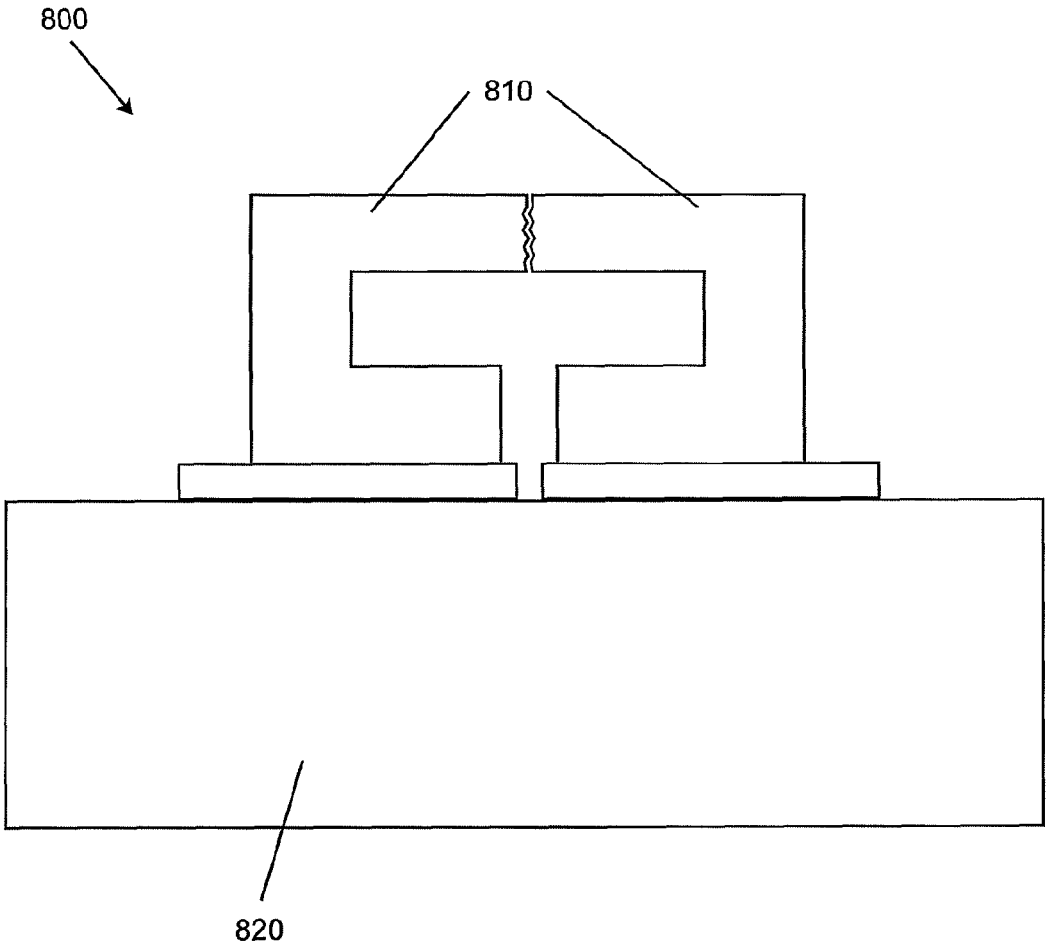
FIG. 9 shows a second view of the clamping mechanism of the first embodiment, with the clamp closed.
Figure 10:
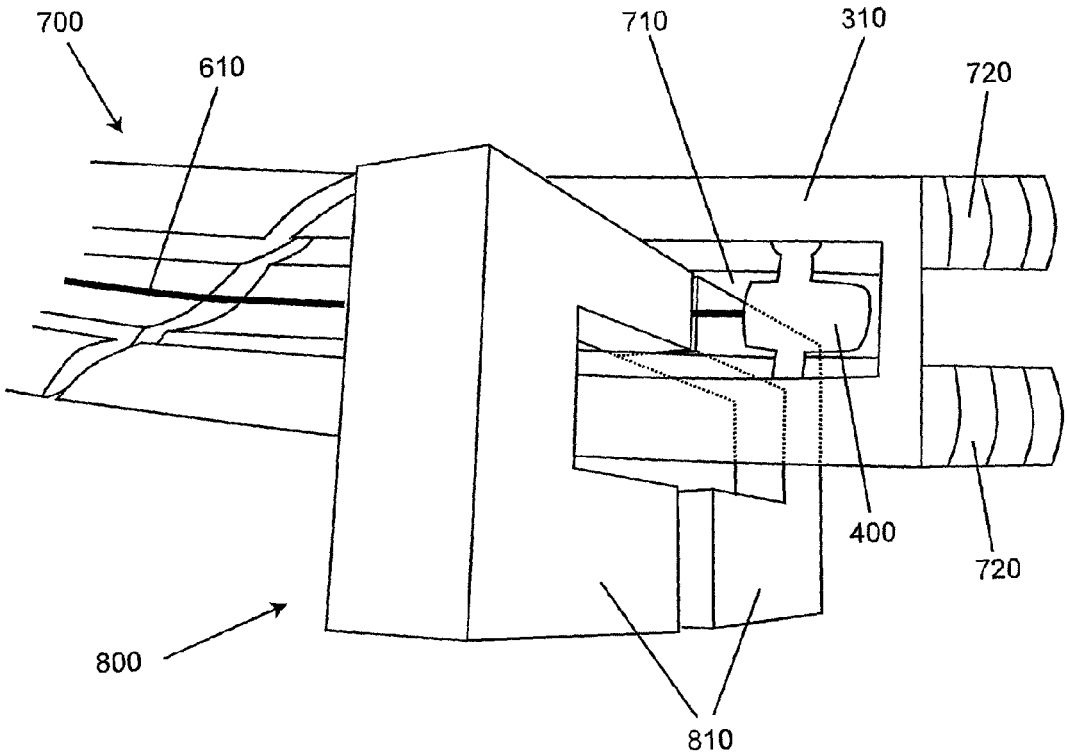
FIG. 10 shows a third view of the clamping mechanism of the first embodiment with the track egress region.

The clamping mechanism 800 of the first embodiment is illustrated in the open position by FIG. 8, and in the closed position by FIG. 9. The clamping mechanism 800 under this embodiment includes an air-powered robotic gripper 820, which changes state very rapidly. Other gripping mechanisms are also possible; for example, gears or hydraulics may be used to actuate the gripper. The air-powered gripper may be capable of, for example, 36 lbs of force at 100 psi. As shown in FIG. 10, the clamping mechanism 800 is fitted with jaws 810 that may fit into the egress region aperture 710 in the egress region 700 of the knot tying track 310. The jaws 810 may be ridged to help grip the wire securely. Note that hard metal wire may wear down the ridges in the relatively soft plastic of the first embodiment. In accordance with an alternative embodiment of the invention, the ends of the jaws 810, or the entirety of the jaws 810, may be made out of metal for durability.

The purpose of the clamping mechanism 800 is to hold the end of the wire 610 while the segment of the wire 610 that is threaded through the wire feeding mechanism 100 (FIG. 1) is pulled back, tightening the knot. As the knot is tightened, the wire 610 may be extracted from the guide track 310 through the open area 560 (FIG. 5), and may be passed through the slit regions 320 (FIG. 3). Once the knot is tight, the clamping mechanism 800 may be released, freeing the tightened knot. Air flow to the clamping mechanism 800 may be electrically controlled from a control system, as described below, for example by solenoid-actuated valves. The wire 610 may be removed from the wire feeder 100 (FIG. 1) as described above.

Wire Insertion Notes

Figure 11:
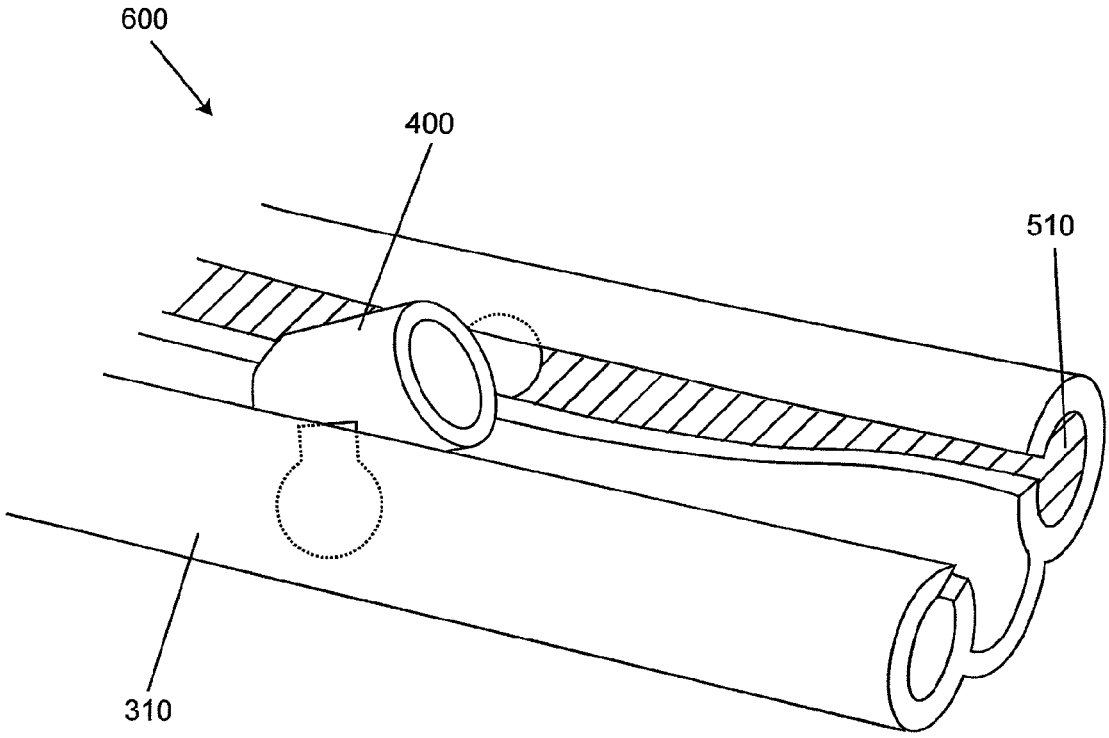
FIG. 11 shows a detail of the ingress end of the track of the first embodiment.
Figure 12:
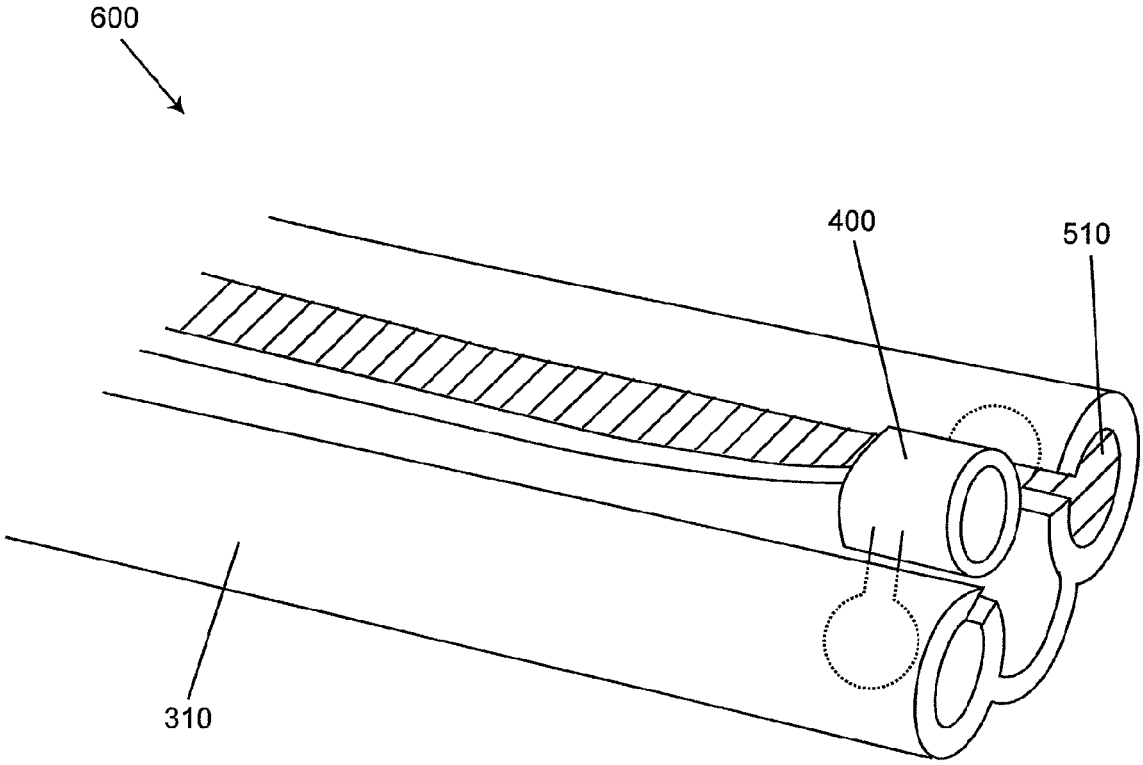
FIG. 12 shows a detail of the truck at the ingress end of the track of the first embodiment.

Automatic insertion of the wire 610 (FIG. 6) into the truck 400 (FIG. 4) may be facilitated when the truck 400 (FIG. 4) is in a known location in the track 310 (FIG. 3), and when the wire feeding mechanism 100 (FIG. 1) is capable of feeding wire 610 (FIG. 6) into a relatively small target such as, for example, into a 3.5 mm diameter wire insertion cavity 450 in truck 400 (FIG. 4). As shown in FIG. 11, the truck 400 may be positioned in a known location near the ingress end 600 of the track 310 by narrowing slots in the guide tubes 510 of the track 310. As shown in FIG. 12, this narrowing of the slots in the guide tubes 510 may place the truck 400 in a horizontal orientation at the ingress end 600 of the track 310, and also may prevent the truck 400 from sliding out of the track 310 ingress end 600.

Figure 13:
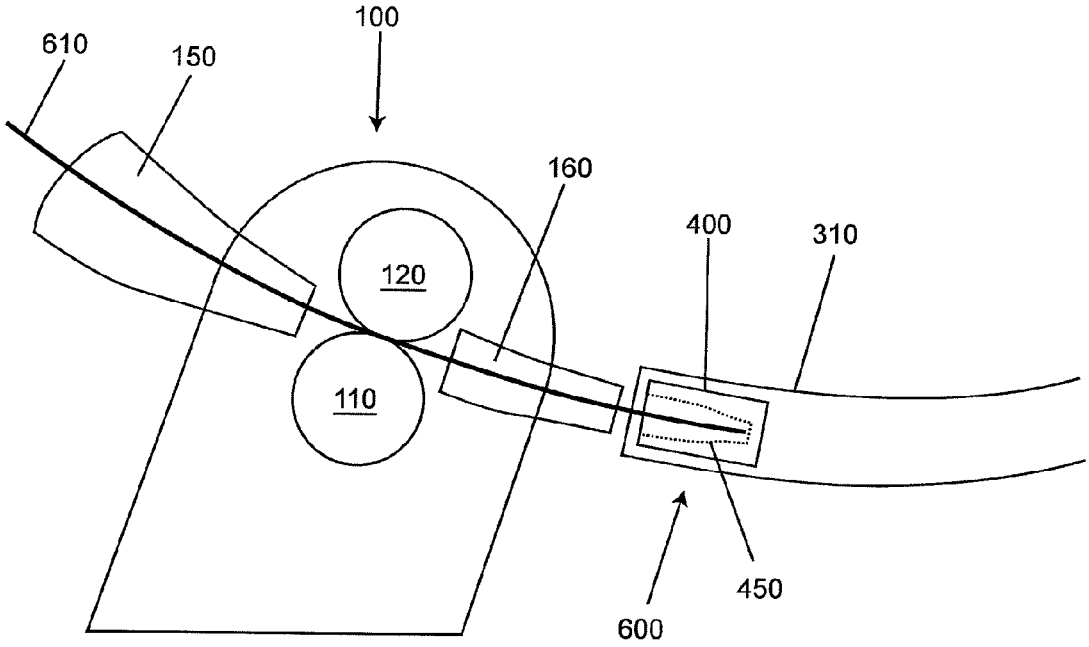
FIG. 13 shows the feeding mechanism of the first embodiment in communication with the knot tying portion.

As shown in FIG. 13, alignment of the wire feeding mechanism 100, combined with the narrow guide tubes 510 (FIG. 11) attached to the wire feeding mechanism 100, may assist the wire feeding mechanism 100 in inserting wire 610 into the wire insertion cavity 450 in the truck 400 within the track 310. The wire feeding mechanism 100 should be oriented to direct a wire 610 into the truck 400 with minimal encumbrances.

Figure 14:
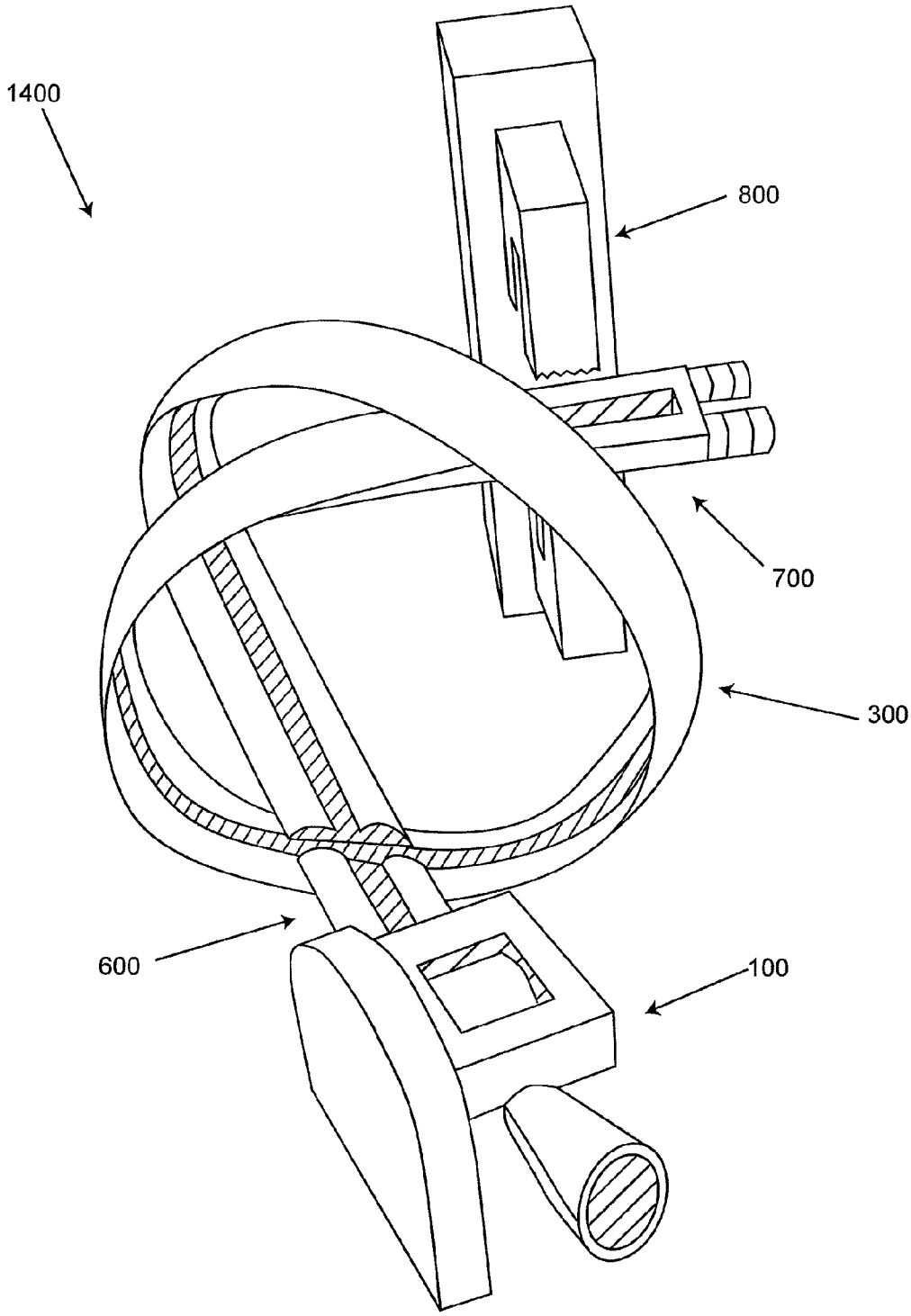
FIG. 14 shows the knotting system of the first embodiment.

The knotting system 1400 of the first embodiment is pictured in FIG. 14. The wire feeding mechanism 100 is positioned at the ingress region 600 of the knot tying portion 300, and the clamping mechanism 800 is positioned at the egress region 700 of the knot tying portion 300.

Control System

Figure 15:
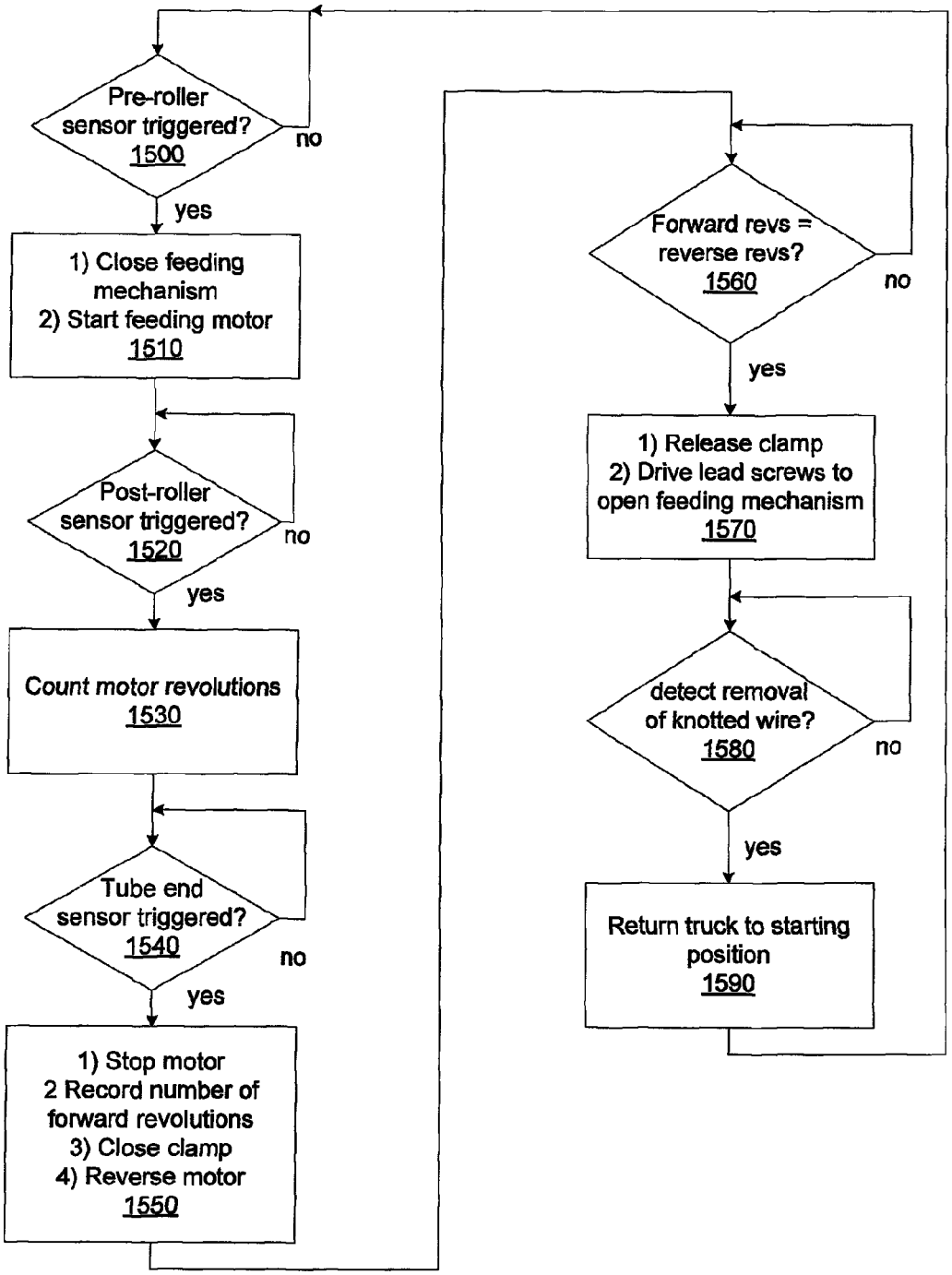
FIG. 15 is a logic flow chart for a knot tying system controller.

A flow chart depicting the logic of a control system is shown in FIG. 15. It should be noted that any process descriptions or blocks in flow charts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

As shown by block 1500, a pre-roller sensor is used to detect the presence of the wire when it approaches the rollers in the ingress guide tube 150 (FIG. 1). The pre-roller sensor may be, for example, an optical sensor. When a wire 610 (FIG. 2) is present, the control system turns the lead screws 145 to close the feeding mechanism (block 1510), thereby securing the wire 610 (FIG. 2) between the rollers and within the feed tubes, and then turns on the motor controlling the drive roller. As shown by block 1520, a post-roller sensor detects the presence of the wire 610 (FIG. 2) after it has passed through the rollers. This post-roller sensor may make it possible to know how much wire has been fed through the rollers, as it may be, for example, at a known distance from the rollers, and wire may be in the rollers when the post-roller sensor detects wire. A pair of passive rollers attached to an encoder may be introduced into the system to more precisely measure the amount of wire to account for possible slippage in the drive roller system. As shown by block 1530, the control system counts the number of forward revolutions used to feed the wire through the knot tying device.

Referring back to FIG. 1, the guide tube extraction slots 155, 165 and adjustable idle roller frame 130 allow for extraction of the wire 610 (FIG. 2) from the feeding mechanism 100, since a knotted wire may not be able to pass back through the tubes 150, 160 and rollers 110, 120. Loosening the long screws 145 may further facilitate sliding the wire 610 (FIG. 2) out through the guide tube extraction slots 155, 165. As described below, the screws 145 may be motorized or otherwise automated. Using lead screws and a small motor may enable automatic opening of the feeding mechanism. The control system (FIG. 15) may drive these lead screws 145 to open the wire feeding mechanism 100 when the control system (FIG. 15) detects that the knot has been tightened, as described further below.

The motor that powers the drive roller 110 may be, for example, a standard 24V DC gear motor, which may run at low RPM in both forward and reverse. The motor may be controlled with an electronic speed control (ESC) that accepts pulse-width modulated (PWM) input, provided by the control system (FIG. 15).

Returning to FIG. 15, as shown by block 1540, a tube-end sensor detects when the truck 400 (FIG. 4) has reached the track egress region 700 (FIG. 7) near the end of the track 310 (FIG. 7). Examples of a tube-end sensor include, but are not limited to, an optical sensor. When the tube-end sensor is triggered (block 1550), the control system closes the clamping mechanism 800 (FIG. 9). Once the end of the wire 610 (FIG. 2) is grasped by the clamping mechanism 800 (FIG. 9), the control system turns on the feeding motor in reverse to pull on the insertion end of the wire 610 (FIG. 2), forming and tightening the knot. As shown by block 1560, when the control system determines that the motor has made approximately the same number of reverse revolutions as forward revolutions used for insertion, the control system assumes that the knot has been tightened. As shown by block 1570, the control system releases the wire 610 (FIG. 2), for example, by opening the clamp 800 (FIG. 8) and opening the lead screws 145 (FIG. 1) on the feeding mechanism 100 (FIG. 1), and notifying the operator that it is possible to remove the tightened knot (block 1580).

As shown by block 1590, the truck 400 (FIG. 4) is returned to the starting position at the track ingress. In the first embodiment, the truck 400 is returned using compressed air. For example, air hoses may be attached to hose attachment points 720 (FIG. 7) at the egress portion 700 (FIG. 7) of the track 310 (FIG. 3), and a short blast of compressed air may be used to return the truck 400 (FIG. 7) through the track 310 (FIG. 3) to the ingress region 600 (FIG. 6) of the track, for example, a blast of air lasting less than one second. In the first embodiment, the control system may trigger this air blast, for example, when the pre-roller sensor detects that the operator has removed the wire 610 (FIG. 2) from the system. In other embodiments the truck 400 (FIG. 4) may be returned from the egress region 700 (FIG. 7) of the track to the ingress region 600 (FIG. 6) of the track using other mechanisms, such as using a short force impulse with a piston or plunger to propel the truck 400 (FIG. 4) from the egress region 700 (FIG. 7) of the track to the ingress region 600 (FIG. 6) of the track.

An alternative embodiment of the knot tying apparatus may have a wire feeding mechanism located at the egress end of the knot tying portion. This egress end wire feeding mechanism may be used in conjunction with the wire feeding at the ingress region of the knot tying portion, or may be used in place of the wire feeding mechanism at the ingress end of the knot tying portion. Under this alternative embodiment, the egress end wire feeding mechanism may feed and recoil a wire that is permanently attached to the truck. The egress end wire feeding mechanism may provide a means for returning the truck from the egress end to the ingress end. Similarly, the egress end wire feeder may facilitate drawing string or other non-rigid knotting material fastened to the truck through the knot tying portion.

In summary, a knot tying apparatus, system and control system has been presented. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

I claim:

1. A system for tying knots, comprising:

a feeding mechanism, further comprising a drive roller and an idle roller capable of guiding a wire;

a truck, removably connected to an end of the wire; and a guide track, fixed relative to the feeding mechanism and configured to slideably contain the truck, wherein the guide track provides a curved track in the shape of a knot desired, and wherein the guide track comprises:

a wire ingress end and a wire egress end;

a tube having a wire extraction slot running along the length of the tube;

an intersection region where an outer portion of the guide track intersects an inner portion of the guide track; and a slit through the inner portion of the guide track substantially at the intersection region.

2. The system of claim 1, wherein the truck further comprises a cap and a magnet located inside the cap, wherein the wire is loosely gripped by the magnet.

3. The system of claim 1, further comprising a wire clamping mechanism located substantially at the guide track wire egress end.

4. The system of claim 1, further comprising a means for returning the truck from the guide track wire egress end to the guide track wire ingress end.

5. An apparatus for tying knots in a wire, comprising:

a slotted guide track comprising an ingress end and an egress end, wherein the guide track provides a curved track for the wire passing therethrough in the shape of a knot desired;

a clamp at the guide track egress end whereby the wire may be secured near the guide track egress end;

a guide track extraction slit passing entirely through the guide track, whereby the wire may be extracted from the guide track while the wire is attached near the ingress end and attached in the clamp; and a first wire feeder capable of guiding a wire into the guide track ingress end, the first wire feeder comprising a wire feed path and a wire feeder extraction path whereby the wire may be removed from the wire feeder extraction path independently of the wire feed path.

6. The apparatus of claim 5, wherein the first wire feeder further comprises a drive roller and an idle roller capable of guiding a wire, and a pinch gap having a pinch gap size comprising a distance between the drive roller and the idle roller.

7. The apparatus of claim 6, wherein the pinch gap size is adjustable.

8. The apparatus of claim 5, wherein the wire feeder extraction path comprises a slot in the first wire feeder running substantially parallel to the wire feed path.

9. The apparatus of claim 6, further comprising a means for drawing the wire through the guide track.

10. The apparatus of claim 9, wherein the means for drawing the wire through the guide track comprises a truck slideably disposed substantially within the guide track, the truck comprising a wire end securing means.

11. The apparatus of claim 10, wherein the truck wire end securing means comprises a magnet.

12. The apparatus of claim 10, wherein the truck wire end securing means comprises a clamp.

13. The apparatus of claim 10, wherein the means for drawing the wire through the guide track comprises feeding the wire into the guide track with the first wire feeder, thereby advancing the truck through the guide track.

14. The apparatus of claim 10, wherein the means for drawing the wire through the guide track comprises blowing air through guide thereby advancing the truck through the guide track.

15. The apparatus of claim 10, wherein the means for drawing the wire through the guide track comprises:

a guide wire connected to the truck; and a second wire feeder disposed substantially at the track egress end, the second wire feeder configured to advance and retract the guide wire.

16. The apparatus of claim 10, further comprising:

a clamp sensor;

a wire feeding mechanism feed path ingress sensor; and a guide track egress sensor.

17. The apparatus of claim 16, further comprising a controller in communication with the clamp sensor, the wire feeding mechanism feed path ingress sensor, and the guide track egress sensor.

18. A method for tying a knot in a wire, comprising the steps of:

forming a slotted guide track substantially in the shape of a desired knot, the guide track having an ingress end and an egress end;

forming an extraction slit substantially through the slotted guide track at a location in the guide track between the ingress end and the egress end;

guiding the wire into the guide track ingress end;

passing the wire substantially through the guide track to the egress end;

clamping the wire substantially at the egress end of the guide track with a clamp; and extracting the wire from the guide track while the wire is clamped substantially by pulling the wire through the guide track slot and pulling the wire through the extraction slit.

19. The method of claim 18, further comprising the steps of:

inserting a wire into a wire feeder, the wire feeder comprising a feed path having a feed path ingress and a feed path egress, and a wire extraction path, the wire extraction path comprising a slot through the wire feeder substantially parallel to the feed path; and engaging the wire in a wire feeder wire advancement mechanism.

20. The method of claim 19, further comprising the steps of:

detecting the wire at the feed path ingress;
activating the wire feeder advancement mechanism;
detecting the wire at the guide track egress end;
stopping the wire feeder advancement mechanism;
activating an automated clamp closing mechanism;
reversing the wire feeder wire advancement mechanism;
detecting when a knot in the wire has formed; and
disengaging the wire from the wire feeder advancement mechanism.

21. The method of claim 20, further comprising the step of detecting when the wire is secured in the clamp.

22. In a knot tying system comprising a wire feeding mechanism capable of guiding a wire, a slotted guide track comprising an ingress end and an egress end, wherein the guide track provides a curved track for the wire passing therethrough in the shape of a knot desired, a clamp at the guide track egress end whereby the wire may be secured near the guide track egress end, and a guide track extraction slit passing entirely through the guide track, whereby the wire may be extracted from the guide track while the wire is attached near the ingress end and attached in the clamp, a clamp sensor, a wire feeding mechanism feed path ingress sensor, and a guide track egress sensor, a computer readable media configured to perform the steps of:

sensing a wire at the feed path ingress;
starting the wire feeder advancement mechanism;
sensing the wire at the guide track egress end;
stopping the wire feeder advancement mechanism;
activating an automated clamp closing mechanism;
reversing the wire feeder wire advancement mechanism; and
disengaging the wire from the wire feeder advancement mechanism.

23. The computer readable media of claim 22, further configured to perform the step of sensing when a knot in the wire has been formed.

24. The computer readable media of claim 22, further configured to perform the step of sensing when the wire is secured in the clamp.

* * * * *